US006921031B2

(12) United States Patent
Puffe

(10) Patent No.: US 6,921,031 B2
(45) Date of Patent: Jul. 26, 2005

(54) ROTARY APPLICATION HEAD

(75) Inventor: Wolfgang Puffe, Buchholz-Mendt (DE)

(73) Assignee: Nordson Corporation, Westlake, OH (US)

( * ) Notice: Subject to any disclaimer, the term of this patent is extended or adjusted under 35 U.S.C. 154(b) by 113 days.

(21) Appl. No.: 10/373,290

(22) Filed: Feb. 24, 2003

(65) Prior Publication Data

US 2003/0173429 A1 Sep. 18, 2003

(30) Foreign Application Priority Data

Mar. 12, 2002 (DE) ..... 102 10 748

(51) Int. Cl.[7] ..... A62C 31/00

(52) U.S. Cl. ..... 239/436; 239/133; 239/290; 239/437; 239/438; 239/439; 239/440; 118/301

(58) Field of Search ..... 239/436–441; 118/301

(56) References Cited

U.S. PATENT DOCUMENTS 4,667,879 A * 5/1987 Muller ..... 239/133
6,024,299 A * 2/2000 Drozkowski ..... 239/290
6,464,785 B1 * 10/2002 Puffe ..... 118/301

FOREIGN PATENT DOCUMENTS

| | | |
|---|---|---|
| DE | 44 16 747 A1 | 11/1995 |
| DE | 197 57 237 A1 | 7/1999 |
| DE | 197 57 238 A1 | 7/1999 |

* cited by examiner

*Primary Examiner*—David A. Scherbel
*Assistant Examiner*—James S. Hogan

(57) ABSTRACT

An application head for applying, in a non-contacting way, liquid media to a length of material which is movable relative to the application head. The head includes a housing, a cylinder chamber in the housing, in which cylinder chamber a cylinder slide is rotably drivably supported, and a nozzle for ejecting medium, which nozzle can be controlled by the cylinder slide and extends transversely to the direction of movement of the length of material. The cylinder slide includes a cylindrical surface which, from the inside, can seal supply means leading to the nozzle. The cylinder slide also includes at least one surface groove in the cylindrical surface, which surface groove can be supplied with liquid medium and which, as a function of the rotational position, is able to communicate with the supply means leading to the nozzle. The at least one surface groove includes delimiting edges with a variable gradient relative to the circumferential direction.

34 Claims, 4 Drawing Sheets

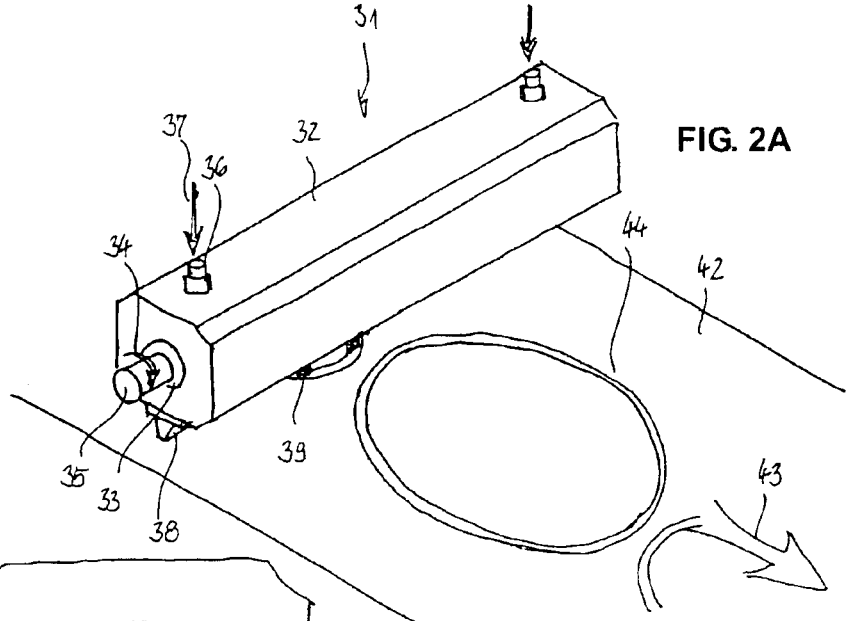
FIG. 2A
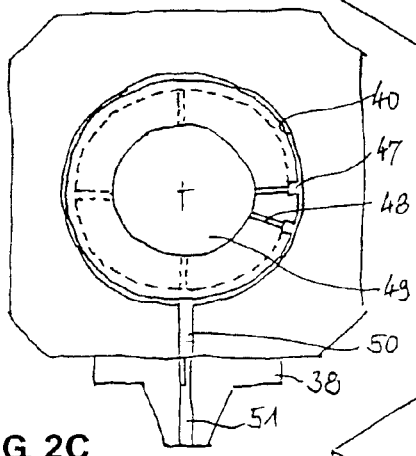
FIG. 2C
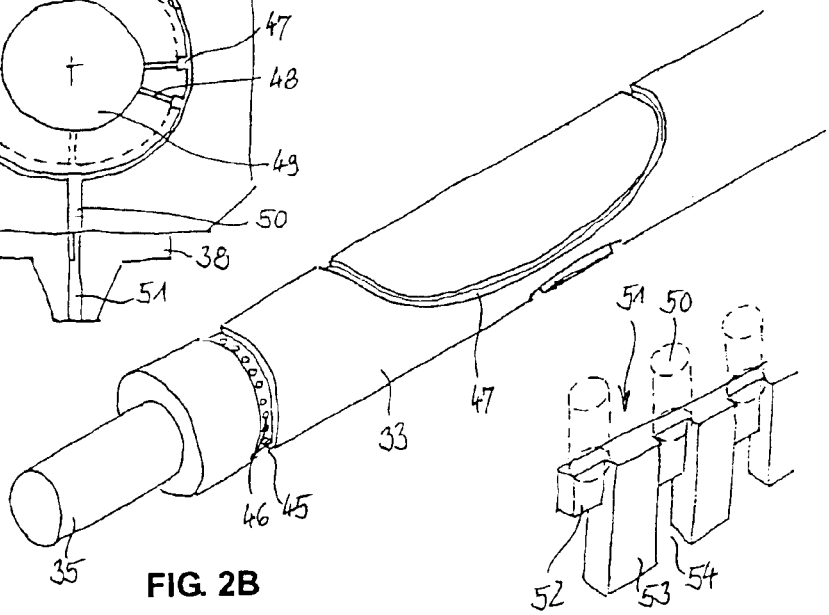
FIG. 2B
FIG. 2D

ROTARY APPLICATION HEAD

TECHNICAL FIELD

The invention relates to an application head for applying liquid media such as liquefied thermo-plastic plastics or melted hot-melting adhesives to a length of material which is movable relative to the application head.

BACKGROUND OF THE INVENTION

One example of a rotary application head includes a housing and a cylinder chamber in the housing, wherein the cylinder chamber includes a cylinder slide rotably drivably supported. The application head also includes at least one supply aperture for introducing a medium into the cylinder chamber and a nozzle for ejecting the medium, which nozzle can be controlled by the cylinder slide and extends transversely to the direction of movement of the length of material. The application head may be mounted in a non-contacting way with respect to the length of material.

An application head of the foregoing type is disclosed in U.S. Pat. No. 6,024,299 wherein a cylinder slide is shown which, in an axial region comprising the supply aperture, includes a recess extending over the entire circumference. At least in this axial region, no exit nozzle opening controlled by the cylinder slide can be provided. This means that, in this axial region, the exit nozzle apertures must be arranged at an undesirably long distance. In addition, the cylinder slide is relatively short. If it had a greater length, it would be necessary to provide a plurality of supply apertures. As a result, the above-mentioned problem along the nozzle would be multiplied accordingly.

A further application head of this type is known from DE 197 57 238 C2 wherein the surface grooves are formed by axis-parallel grooves on the cylinder slide or by parallel helical grooves on the cylinder slide. Both embodiments are said to achieve the application of an economical mount of extremely uniformly distributed liquid medium on the length of material.

Application heads of the above-mentioned type are widely used in those cases where lengths of material have to be laminated on to a substrate. To reduce the specific consumption of liquid medium to a minimum and to ensure an extremely uniform distribution of the medium, the medium is applied intermittently in order to achieve a grid-like application image. In order to permit a high transport speed for the length of material, the application of medium in the direction of movement of the length of material has to take place at a high frequency, with the grid points transverse to the direction of movement of the length of material having to be positioned as closely as possible to one another.

SUMMARY OF THE INVENTION

The present invention provides an application head of the above-mentioned type wherein the application of liquid medium for special uses is freely selectable and can be reduced as compared to known application heads.

The present application head comprises, in the housing, a number of supply bores extending from the cylinder chamber to the nozzle. The nozzle forms a plurality of individual exit apertures which each communicate with one of the supply bores in the housing. The cylinder slide comprises a cylindrical surface which is able to seal from the inside the supply bores leading to the nozzle. The cylinder slide, in the cylindrical surface of the slide, comprises at least one surface groove which can be supplied with a liquid medium and which, as a function of the rotational position, is able to communicate with the supply bores leading to the nozzle. Also, the at least one surface groove is designed figuratively or ornamentally.

The phrase "figurative or ornamental surface grooves" means that the surface grooves comprise limiting edges having a variable gradient or pitch relative to the circumferential direction, and that the position of the limiting edges along the slide axis changes non-uniformly in the circumferential direction. It is not intended to mean linearly extending surface grooves of a constant width.

In this way, it is possible to deviate from a uniform application and to produce figurative or ornamental application patterns. Such patterns can be beneficial if, at a later stage, the length of material to be laminated on to a substrate is subjected to greater loads in some places than in others. Thus, the areas which are desired to be fixed more securely can receive a higher density application pattern. The variable application patterns are also beneficial if the length of material, which at a later stage has to be laminated on to a substrate, comprises cuts which do not require a prior application of medium. One example is the production of slip inserts consisting of a multi-layer material with gluing taking place along the circumferential edge, forming an hourglass shape.

According to a first embodiment, the surface grooves comprise a plurality of continuous grooves with variable widths in the cylindrical surface. According to a second embodiment, the surface grooves comprise at least one groove which, in a developed view, forms a closed curve, e.g. a circle, so as to produce an application result of the same form. According to a third embodiment, the surface grooves comprise at least one groove with a limited circumferential length and a variable width in the cylindrical surface.

According to a further embodiment, the cylinder slide comprises an inner cavity which can be supplied with a liquid medium, as well as radial exit bores which lead from the inner cavity to the surface grooves. The surface grooves are supplied with liquid medium via the interior of the cylinder slide. According to an alternative embodiment, the cylinder slide comprises at least one circumferential groove which can be supplied with a liquid medium, as well as connecting grooves which lead from the circumferential groove into the at least one surface groove. In this way, the surface grooves are supplied via the surface of the cylinder slide.

Furthermore, an application head in accordance with the invention is also provided as a slotted nozzle with a diaphragm which forms a plurality of exit apertures along the slotted nozzle. In particular, the diaphragm is formed by a comb-type plate which is inserted into the slotted nozzle and comprises a plurality of prongs between which a plurality of exit apertures is formed.

To be able to supply the interior of the cylinder slide with medium continuously, the cylinder slide comprises at least one journal which axially projects from the housing and which is provided with an axial bore which is connected to an inner cavity and serves to supply liquid medium. In a further embodiment, at least one end of the housing is provided with a sleeve, and an annular channel is formed between the cylinder slide and the cylinder chamber. The annular channel is connected to the sleeve in the housing, and radial supply bores in the cylinder slide are formed in the plane of the annular channel. The supply bores are connected to the inner cavity and serve to supply liquid medium.

The annular channel in the foregoing embodiment can be formed by an annular groove in the cylinder chamber surface. The annular channel is preferably formed by a circumferential groove in the surface of the cylinder slide, which circumferential groove is connected to the supply sleeve in the housing. The medium can also be guided further by transverse connecting grooves in the surface of the cylinder slide, which extend as far as the at least one inventive surface groove. In this case, the nozzle in the transverse direction would not extend beyond the at least one surface groove. However, according to another embodiment, the medium is guided from the annular groove into the inner cavity and from there again into the surface groove, as already described in detail above.

From the inventive surface grooves the medium reaches radial bores which extend along the housing. Depending on the change in the extension of the edges of the surface grooves in the circumferential direction, more or fewer or other radial bores are loaded while the cylinder slide rotates, so that the spray veil at the nozzle narrows or widens, respectively. Individual threads extending transversely to the direction of movement of the length of material can be produced by using a suitable diaphragm with exit apertures provided at short distances from one another in the nozzle. Preferably, one radial bore in the housing is connected to one exit aperture in the diaphragm.

Other advantages and features of the invention will also become apparent upon reading the following detailed description and appended claims, and upon reference to the accompanying drawings.

BRIEF DESCRIPTION OF THE DRAWINGS

For a more complete understanding of this invention, reference should now be made to the embodiments illustrated in greater detail in the accompanying drawings and described below by way of examples of the invention.

In the drawings.

Figure 1A:
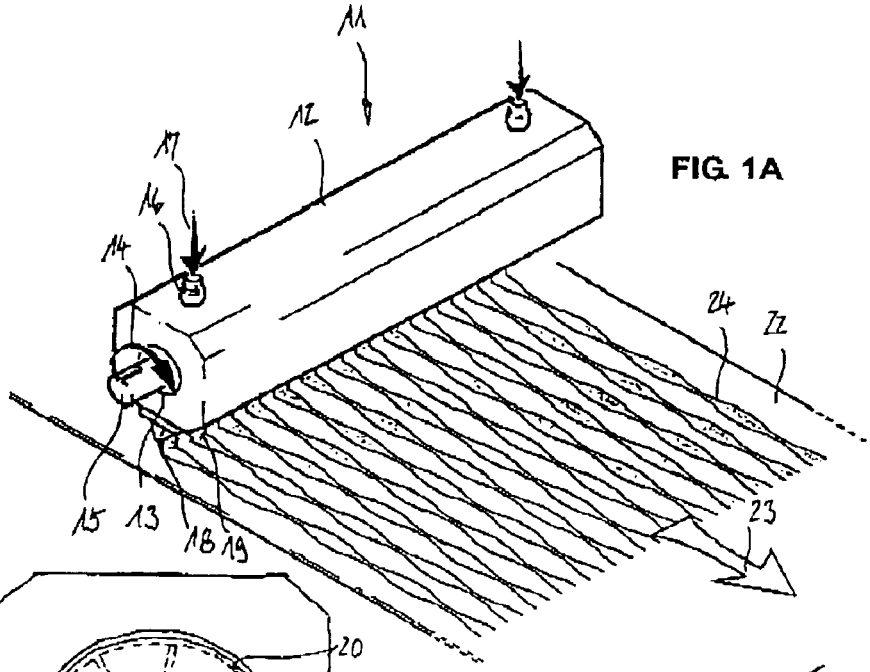
FIG. 1 shows.
Figure 1C:
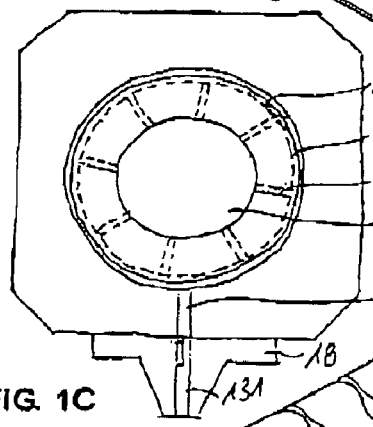
Figure 1B:
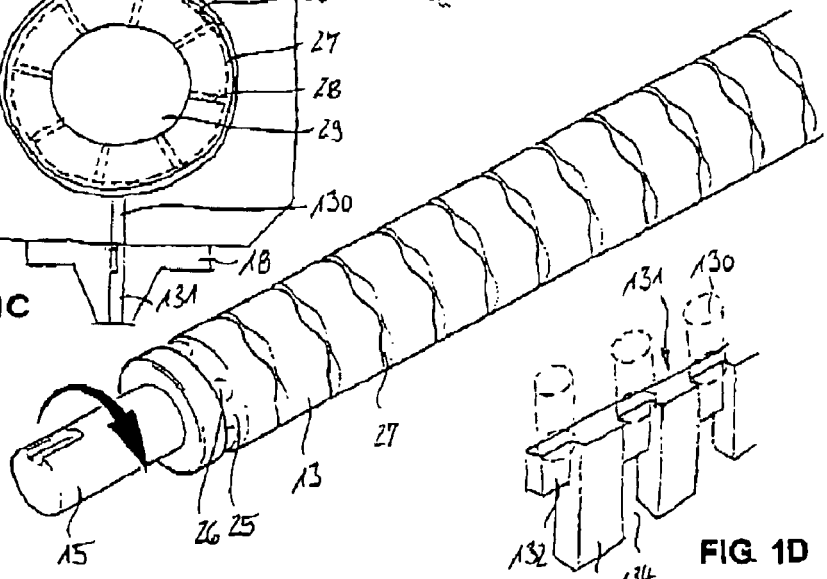

(A) a perspective view of an application head with circumferentially extending surface grooves of variable widths provided in the cylinder slide and with supply means for supplying medium across the housing;

(B) a perspective view of the cylinder slide of FIG. 1A;

(C) a cross-sectional view of the cylinder slide of FIG. 1B;

(D) a detail of the comb-type plate of the application head of FIG. 1A.

FIG. 2 shows:

(A) a perspective view of an application head with a surface groove of a constant width provided in the cylinder slide, with the surface groove being circular in a developed view, and showing supply means for supplying medium across the housing;

(B) a perspective view of the cylinder slide of FIG. 2A;

(C) a cross-sectional view of the cylindrical slide of FIG. 2B;

(D) a detail of the comb-type plate of the application head of FIG. 2A.

Figure 3A:
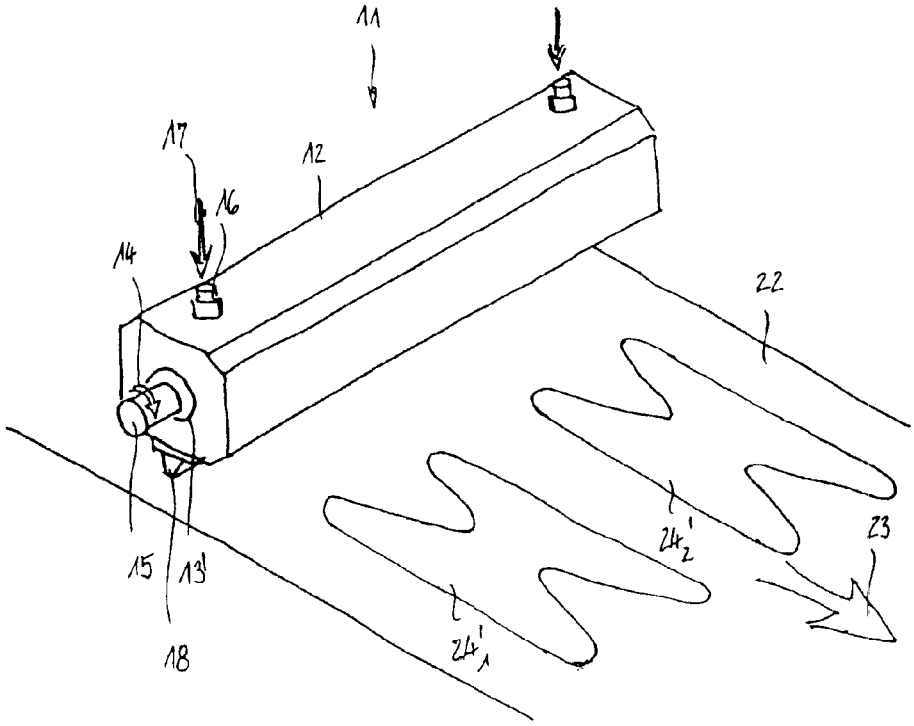

FIG. 3 shows:

(A) a perspective view of an application head with two circumferentially extending surface grooves of limited circumferential length and variable widths provided in the cylinder slide and a supply means for supplying medium across the housing;

(B) a perspective, fragmented view of the cylinder slide of FIG. 3A.

Figure 4A:
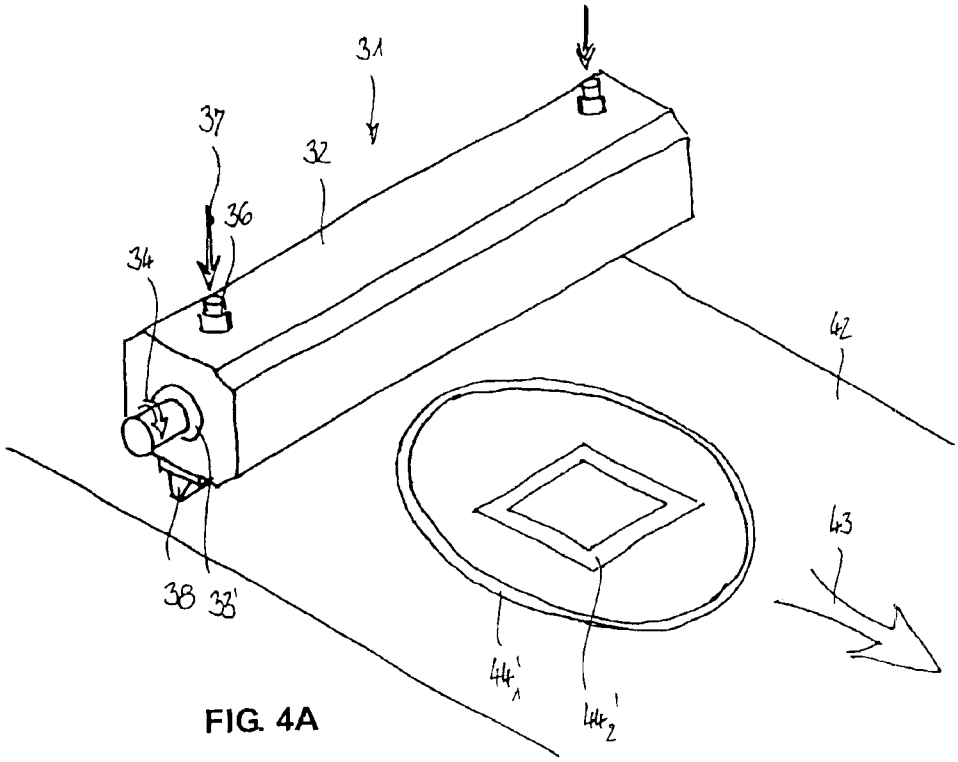

FIG. 4 shows:

(A) a perspective view of an application head with two surface grooves of a constant width provided in the cylinder slide, with the surface groove being continuous and lying in another in a developed view, and a supply means for supplying medium across the housing;

(B) a perspective view of the cylinder slide of FIG. 4A.

DETAILED DESCRIPTION OF THE INVENTION

FIGS. 1 and 2 each show (a) an application head with a length of material comprising an application pattern, in a perspective view; (b) the cylinder slide in the form of a detail in a perspective view; (c) the housing with a cylinder slide in a cross-sectional view and (d) a comb-type plate with housing bores in the form of a detail.

FIG. 1 shows an application head 11 with an oblong, cubic shape. From the housing 12 of the application head 11 there projects one end of a cylinder slide 13. The direction of rotation of the cylinder slide 13 is indicated by an arrow 14. The end of the cylinder slide 13 comprises a journal 15. The cylinder slide 13 can be driven via the journal 15 by a servomotor, for example. The housing 12 is provided with two supply sleeves 16 via which medium can be supplied, as indicated by arrows 17. The liquid media can be liquid thermoplastic or hot melting adhesive, for example. At the lower end of the housing 12, there is shown a nozzle 18 from which there emerge individual spray veils 19. The spray veils 19 hit the length of material 22 whose direction of movement is symbolized by an arrow 23. The spray veils 19 produce individual application strips 24 on the length of material 22, which strips 24 comprise periodically variable widths. The variable widths are caused by the variable widths of the circumferential surface grooves 27 of the cylinder slide 13. The nozzle 18 contains a comb-type plate which produces threads which extend perpendicularly relative to the direction of movement of the length of material 22, but which, after having emerged, converge to form the spray veil 19.

As can be seen in FIG. 1B, the cylinder slide 13, at its cylindrical surface, comprises a plurality of circumferential surface grooves 27 with periodically variable widths, Furthermore, as can be seen in the cross-sectional view shown in FIG. 1C, the circumferential surface grooves 27 are supplied with medium via radial bores 28 from an inner cavity 29. The cavity 29, in turn, is supplied with medium via the supply sleeves 16, annular grooves 25 and radial bores 26 in the cylinder slide 13. The annular groove 25 is sealed by shaft seals relative to the region of the cylinder slide which is provided with surface grooves 27. The circumferential surface grooves 27 are constantly supplied with medium via the radial bores 28. As can also be seen in the cross-sectional view, the cylinder slide 13 runs in a cylindrical slide chamber 20 of the housing 12, from which cylinder chamber 20 radial bores 130 in the housing 12 lead to the nozzle 18.

Figure 1D:
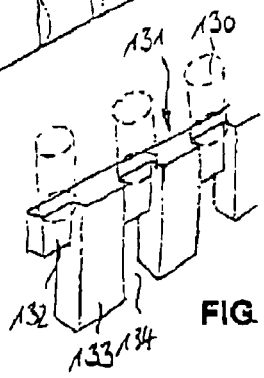

As can be seen in FIG. 1D, a comb-type plate 131 in the nozzle 18 is provided with webs 132 of a smaller thickness, so that each of the radial bores 130 is permanently openly connected to one of the exit apertures 134 positioned between the prongs 133 of the comb-type plate.

FIG. 2 also shows an application head with an oblong, cubic shape. From the housing 32 of the application head 31 there projects one end of a cylinder slide 33. The direction of rotation of the cylinder slide 33 is indicated by an arrow 34. The end of the cylinder slide 33 comprises a journal 35. The cylinder slide 33 can be driven via the journal 35 by a servomotor, for example. The housing 32 is provided with two supply sleeves 36 via which medium can be supplied, as indicated by arrows 37. At the lower end of the housing 32, there is shown a nozzle 38 from which there emerges a variable spray veil 39. The spray veil 39 hits a length of material 42 whose direction of movement is symbolized by an arrow 43. The spray veil produces an application pattern 44 on the length of material 43, which comprises a series of circles with substantially identically sized line thicknesses. The application pattern could also include variable line thicknesses. The nozzle 38 contains a comb-type plate which produces individual threads which extend perpendicularly relative to the direction of movement of the length of material 42 and which, immediately after having emerged, converge to form the spray veil 39.

As can be seen in FIG. 2B, the cylinder slide 33, at its cylindrical surface, comprises a surface groove 47 which, in a developed view, has the approximate shape of a circle. Furthermore, as can be seen in the cross-sectional view shown in FIG. 2C, the surface groove 47 is supplied with medium via radial bores 48 from an inner cavity 49. The cavity 49, in turn, is supplied with medium via supply sleeves 36, annular grooves 45 and radial bores 46 in the cylinder slide 33. The annular groove 45 is sealed by shaft seals relative to the region of the cylinder slide which is provided with surface grooves 47. The surface groove 47 is constantly filled with medium via the radial bores 48. As can also be seen in the cross-sectional view, the cylinder slide 33 runs in a cylindrical slide chamber 40 of the housing 32, from which cylinder chamber 40 radial bores 50 in the housing 32 lead to the nozzle 38.

As illustrated in FIG. 2D, a comb-type plate 51 in the nozzle 38 is provided with webs 52, so that each of the radial bores 50 is permanently openly connected to one of the exit apertures 53 positioned between the prongs 53 of the comb-type plate.

FIGS. 3 and 4 each show (a) an application head with a length of material comprising an application pattern, in a perspective view; and (b) the cylinder slide in the form of a detail in a perspective view.

FIG. 3 shows an application head 11 with an oblong, cubic shape. From the housing 12 of the application head 11 there projects one end of a cylinder slide 13'. The direction of rotation of the cylinder slide 13' is indicated by an arrow 14. The end of the cylinder slide 13' comprises a journal 15. The cylinder slide 13' can be driven via the journal 15 by a servo-motor, for example. The housing 12 is provided with two supply sleeves 16 via which medium can be supplied, as indicated by arrows 17. At the lower end of the housing 12, there is shown a nozzle 18 from which there can emerge individual spray veils. The spray veils hit the length of material 22 whose direction of movement is symbolized by an arrow 23. The spray veils produce individual application strips 24' on the length of material 22, which strips 24' comprise periodically variable widths and limited length. The variable widths are caused by the variable widths of the part-circumferential surface grooves 27 of the cylinder slide 13. The nozzle 18 contains a comb-type plate which produces threads which extend perpendicularly relative to the direction of movement of the length of material 22, but which, after having emerged, converge to form the spray veil.

Figure 3B:
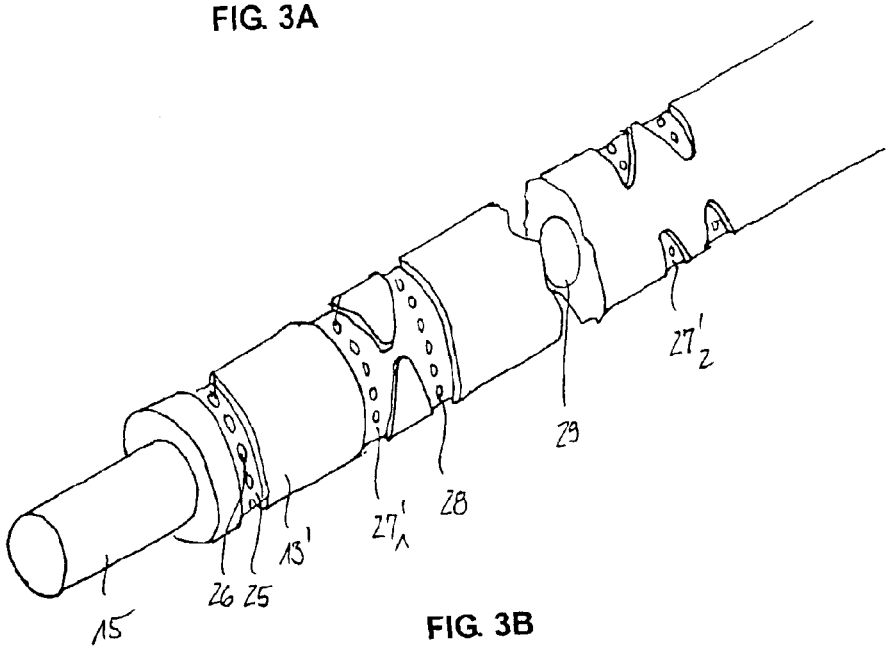

As can be seen in FIG. 3B, the cylinder slide 13', at its cylindrical surface, comprises a plurality of two part-circumferential surface grooves 27' with variable widths and limited circumferential length. The cylinder slide is shown in two broken off axial portions, which are rotated with respect to one another by 180° compared to their true relationship. A center portion of a first part-circumferential surface groove $\mathbf{27}_1$' and two split end portions of an identical second part-circumferential surface groove $\mathbf{27}_2$' are shown. On the integral cylinder slide 13' the part-circumferential surface grooves $\mathbf{27}_1$', $\mathbf{27}_2$' have identical circumferential positions and produce parallel application strips $\mathbf{24}_1$', $\mathbf{24}_2$'. The part-circumferential surface grooves 27' are supplied with medium via radial bores 28 from an inner cavity 29. The cavity 29, in turn, is supplied with medium via the supply sleeves 16, annular grooves 25 and radial bores 26 in the cylinder slide 13'. The annular groove 25 is sealed by shaft seals relative to the region of the cylinder slide which is provided with surface grooves 27'. The circumferential surface grooves 27' are constantly supplied with medium via the radial bores 28 such as is similarly described with reference to FIGS. 1C and 1D.

FIG. 4 shows an application head with an oblong, cubic shape. From the housing 32 of the application head 31 there projects one end of a cylinder slide 33'. The direction of rotation of the cylinder slide 33' is indicated by an arrow 34. The end of the cylinder slide 33' comprises a journal 35. The cylinder slide can be driven via the journal 35 by a servomotor, for example. The housing 32 is provided with two supply sleeves 36 via which medium can be supplied, as indicated by arrows 37. At the lower end of the housing 32, there is shown a nozzle 38 from which there can emerge a variable spray veil. The spray veil hits a length of material 42 whose direction of movement is symbolized by an arrow 43. The spray veil produces an application pattern on the length of material 43, which comprises a series of circles $\mathbf{44}_1$' and squares $\mathbf{44}_2$' with substantially identically sized line thicknesses. The line thicknesses could also be variable. The nozzle 38 contains a comb-type plate which produces individual threads which extend perpendicularly relative to the direction of movement of the length of material 42 and which, immediately after having emerged, converge to form the spray veil.

Figure 4B:
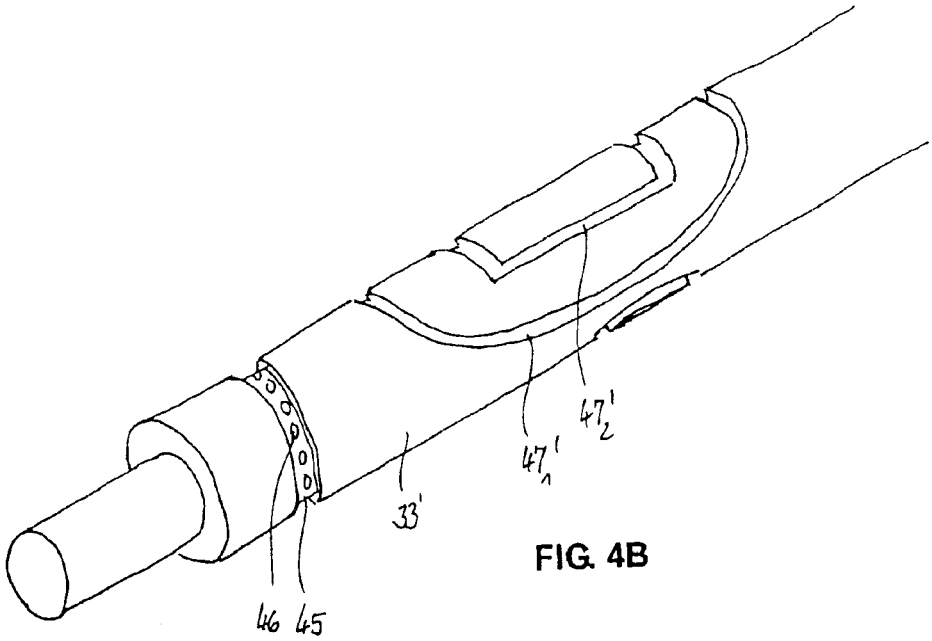

As can be seen in FIG. 4B, the cylinder slide 33', at its cylindrical surface, comprises a first surface groove $\mathbf{47}_1$' which, in a developed view, has the shape of a circle and a second surface groove $\mathbf{47}_2$', which lies within the first one and which, in a developed view, has the shape of a square. Of course, these shapes could be reversed and, as well, other shapes are contemplated. The surface groove 47' is supplied with medium via radial bores from an inner cavity. The cavity, in turn, is supplied with medium via supply sleeves 36, annular grooves 45 and radial bores 46 in the cylinder slide 33'. The annular groove 45 is sided by shaft sides relative to the region of the cylinder slide which is provided with surface grooves 47'. The surface grooves $\mathbf{47}_1$', $\mathbf{47}_2$' are constantly filled with medium via the radial bores such as is similarly described with reference to FIGS. 2C and 2D.

From the foregoing, it can be seen that there has been brought to the art a new and improved rotary application head. While the invention has been described in connection with one or more embodiments, it should be understood that the invention is not limited to those embodiments. For example, the shape of the application patterns can vary from the examples shown. Also, the rotational direction or speed of the cylinder slide can vary. Thus, the invention covers all alternatives, modifications, and equivalents as may be included in the spirit and scope of the appended claims.

What is claimed is:

1. An application head for applying liquid media to a length of material which is movable relative to the application head, the application head comprising:

a housing having a cylinder chamber;

a cylinder slide rotably drivably supported in the cylinder chamber; and a nozzle for ejecting the media, the nozzle being controlled by the cylinder slide and extending transversely to the direction of movement of the length of material, wherein the housing includes a plurality of supply bores extending from the cylinder chamber to the nozzle, and the nozzle forms a plurality of individual exit apertures which each communicate with one of the supply bores in the housing, and wherein the cylinder slide comprises a cylindrical surface which is able to seal from the inside the supply bores leading to the nozzle, the cylindrical surface of the cylinder slide comprising at least one surface groove which can be supplied with a liquid medium and which, as a function of the rotational position, is able to communicate with the supply bores leading to the nozzle, and wherein the at least one surface groove comprises at least one circumferentially continuous groove with variable widths in the cylindrical surface.

2. An application head for applying liquid media to a length of material which is movable relative to the application head, the application head comprising:

a housing having a cylinder chamber;

a cylinder slide rotably drivably supported in the cylinder chamber; and a nozzle for ejecting the media, the nozzle being controlled by the cylinder slide and extending transversely to the direction of movement of the length of material, wherein the housing includes a plurality of supply bores extending from the cylinder chamber to the nozzle, and the nozzle forms a plurality of individual exit apertures which each communicate with one of the supply bores in the housing, and wherein the cylinder slide comprises a cylindrical surface which is able to seal from the inside the supply bores leading to the nozzle, the cylindrical surface of the cylinder slide comprising at least one surface groove which can be supplied with a liquid medium and which, as a function of the rotational position, is able to communicate with the supply bores leading to the nozzle, and wherein the at least one surface groove comprises at least one groove which, as a development, forms a closed curve.

3. An application head for applying liquid media to a length of material which is movable relative to the application head, the application head comprising:

a housing having a cylinder chamber;

a cylinder slide rotably drivably supported in the cylinder chamber; and a nozzle for ejecting the media, the nozzle being controlled by the cylinder slide and extending transversely to the direction of movement of the length of material, wherein the housing includes a plurality of supply bores extending from the cylinder chamber to the nozzle, and the nozzle forms a plurality of individual exit apertures which each communicate with one of the supply bores in the housing, and wherein the cylinder slide comprises a cylindrical surface which is able to seal from the inside the supply bores leading to the nozzle, the cylindrical surface of the cylinder slide comprising at least one surface groove which can be supplied with a liquid medium and which, as a function of the rotational position, is able to communicate with the supply bores leading to the nozzle, and wherein the at least one surface groove comprises at least one groove with a limited circumferential length and a variable width in the cylindrical surface.

4. An application head according to claim 1, wherein the cylinder slide comprises an inner cavity which can be supplied with a liquid medium, as welt as radial exit bores which lead from the inner cavity into the surface grooves.

5. An application head according to claim 2, wherein the cylinder slide comprises an inner cavity which can be supplied with a liquid medium, as well as radial exit bores which lead from the inner cavity into the surface grooves.

6. An application head according to claim 3, wherein the cylinder slide comprises an inner cavity which can be supplied with a liquid medium, as well as radial exit bores which lead from the inner cavity into the surface grooves.

7. An application head according to claim 1, wherein the cylinder slide comprises at least one circumferential groove which can be supplied with a liquid medium, as well as connecting grooves which read from the circumferential groove into the at least one surface groove.

8. An application head according to claim 2, wherein the cylinder slide comprises at least one circumferential groove which can be supplied with a liquid medium, as well as connecting grooves which lead from the circumferential groove into the at least one surface groove.

9. An application head according to claim 3, wherein the cylinder slide comprises at least one circumferential groove which can be supplied with a liquid medium, as well as connecting grooves which lead from the circumferential groove into the at least one surface groove.

10. An application head according to claim 1, wherein the nozzle is a slot and is provided with a diaphragm which forms the plurality of exit apertures along the nozzle.

11. An application head according to claim 2, wherein the nozzle is a slot and is provided with a diaphragm which forms the plurality of exit apertures along the nozzle.

12. An application head according to claim 3, wherein the nozzle is a slot and is provided with a diaphragm which forms the plurality of exit apertures along the nozzle.

13. An application head according to claim 10, wherein the diaphragm is formed by a comb-type plate which is inserted into the nozzle and which comprises a plurality of prongs and exit apertures.

14. An application head according to claim 11, wherein the diaphragm is formed by a comb-type plate which is inserted into the nozzle and which comprises a plurality of prongs and exit apertures.

15. An application head according to claim 12, wherein the diaphragm is formed by a comb-type plate which is inserted into the nozzle and which comprises a plurality of prongs and exit apertures.

16. An application head according to claim 1, wherein the cylinder slide comprises an inner cavity and at least one journal which axially emerges from the housing and in which there is formed an axial bore which is connected to the inner cavity and serves to supply liquid medium.

17. An application head according to claim 2, wherein the cylinder slide comprises an inner cavity and at least one journal which axially emerges from the housing and in which there is formed an axial bore which is connected to the inner cavity and serves to supply liquid medium.

18. An application head according to claim 3, wherein the cylinder slide comprises an inner cavity and at least one journal which axially emerges from the housing and in which there is formed an axial bore which is connected to the inner cavity and serves to supply liquid medium.

19. An application head according to claim 1, wherein at least one end of the housing includes a supply sleeve, and wherein an annular channel is formed between the cylinder slide and the cylinder chamber, the annular channel being connected to the supply sleeve, and wherein in the cylinder slide in the plane of the annular channel, there are formed radial supply bores which are connected to an inner cavity of the cylinder slide and which serve to supply liquid medium.

20. An application head according to claim 2, wherein at least one end of the housing includes a supply sleeve, and wherein an annular channel is formed between the cylinder slide and the cylinder chamber, the annular channel being connected to the supply sleeve, and wherein in the cylinder slide in the plane of the annular channel, there are formed radial supply bores which are connected to an inner cavity of the cylinder slide and which serve to supply liquid medium.

21. An application head according to claim 3, wherein at least one end of the housing includes a supply sleeve, and wherein an annular channel is formed between the cylinder slide and the cylinder chamber, the annular channel being connected to the supply sleeve, and wherein in the cylinder slide in the plane of the annular channel, there are formed radial supply bores which are connected to an inner cavity of the cylinder slide and which serve to supply liquid medium.

22. An application head according to claim 19, wherein the annular channel is formed by an annular groove in the cylinder chamber surface.

23. An application head according to claim 20, wherein the annular channel is formed by an annular groove in the cylinder chamber surface.

24. An application head according to claim 21, wherein the annular channel is formed by an annular groove in the cylinder chamber surface.

25. An application head according to claim 19, wherein the annular channel is formed by a circumferential groove on the cylinder slide.

26. An application head according to claim 20, wherein the annular channel is formed by a circumferential groove on the cylinder slide.

27. An application head according to claim 21, wherein the annular channel is formed by a circumferential groove on the cylinder slide.

28. An application head according to claim 22, wherein the annular channel is sealed by shaft seals relative to a region of the cylinder slide which is provided with surface grooves.

29. An application head according to claim 23, wherein the annular channel is sealed by shaft seals relative to a region of the cylinder slide which is provided with surface grooves.

30. An application head according to claim 24, wherein the annular channel is sealed by shaft seals relative to a region of the cylinder slide which is provided with surface grooves.

31. An application head according to claim 25, wherein the annular channel is sealed by shaft seals relative to a region of the cylinder slide which is provided with surface grooves.

32. An application head according to claim 26, wherein the annular channel is sealed by shaft seals relative to a region of the cylinder slide which is provided with surface grooves.

33. An application head according to claim 27, wherein the annular channel is sealed by shaft seals relative to a region of the cylinder slide which is provided with surface grooves.

34. An application head for applying liquid media to a length of material which is movable relative to the application head, the application head comprising:

a housing having a cylinder chamber;

a cylinder slide rotably drivably supported in the cylinder chamber; and a nozzle for ejecting the media, the nozzle being controlled by the cylinder slide and extending transversely to the direction of movement of the length of material, wherein the housing includes a plurality of supply bores extending from the cylinder chamber to the nozzle, and the nozzle forms a plurality of individual exit apertures which each communicate with one of the supply bores in the housing, wherein the cylinder slide comprises a cylindrical surface which is able to seal from the inside the supply bores leading to the nozzle, the cylindrical surface of the cylinder slide comprising at least one surface groove which can be supplied with a liquid medium and which, as a function of the rotational position, is able to communicate with the supply bores leading to the nozzle, and wherein the at least one surface groove comprises at least one surface groove which includes delimiting edges with a variable gradient relative to the circumferential direction.

* * * * *